United States Patent [19]

Obara

[11] Patent Number: 4,891,623

[45] Date of Patent: Jan. 2, 1990

[54] ELECTRIC REGULATOR UNIT

[75] Inventor: Kazufumi Obara, Tokyo, Japan

[73] Assignee: Stanley Electric Co., Ltd., Tokyo, Japan

[21] Appl. No.: 305,183

[22] Filed: Feb. 2, 1989

[30] Foreign Application Priority Data

Feb. 26, 1988 [JP] Japan ..... 63-24871[U]

[51] Int. Cl.[4] ..... H01C 10/32

[52] U.S. Cl. ..... 338/163; 361/293; 361/417; 200/11 TW

[58] Field of Search ..... 338/152, 163, 315, 318; 361/331, 334, 346, 358, 376, 392, 417, 419, 429, 293; 248/27.1; 200/11 R, 11 TW, 296

[56] References Cited

U.S. PATENT DOCUMENTS

| | | | |
|---|---|---|---|
| 3,809,830 | 5/1974 | Lockard | 200/11 TW |
| 4,190,749 | 2/1980 | Erickson | 200/11 TW |
| 4,549,246 | 10/1985 | Baumler | 361/293 |
| 4,816,801 | 3/1989 | Spiller | 338/163 |

*Primary Examiner*—Gerald P. Tolin
*Attorney, Agent, or Firm*—Nixon & Vanderhye

[57] ABSTRACT

In an electric regulator unit, a variable electric component has a body which is accommodated in a recess formed in one axial end face of a holder against angular movement relative thereto about an axis of an operating shaft of the variable electric component such that the operating shaft extends away from a bottom of the recess. An assembly of the holder and the variable electric component is accommodated in a recess formed in one axial end face of a knob such that the operating shaft is engaged with a bottom of the recess in the knob. The arrangement is such that when an outer peripheral surface of the knob is manipulated, the knob is angularly moved to move the operating shaft angularly about the axis thereof relatively to the body. At least one friction-torque imparting element is arranged between the knob and the assembly for imparting friction torque to the angular movement of the knob relative to the holder and the body.

12 Claims, 3 Drawing Sheets

ELECTRIC REGULATOR UNIT

BACKGROUND OF THE INVENTION

The present invention relates to an electric regulator unit for regulating various quantities of state in instruments such as an air conditioner for automotive vehicles, a car stereo player and the like.

Conventionally, there is known an electric regulator unit shown in FIGS. 1 and 2 of the accompanying drawings. The known electric regulator unit, generally designated by the reference numeral 1, comprises a holder 2 which is arranged wthin a body frame of an instrument such as an air conditioner (not shown) or the like. The holder 2 is mounted to one of a pair of mount plates of the body frame against rotation relative thereto. The holder 2 has a cylindrical outer peripheral surface and has one axial end face formed therein with a recess. A variable electric component 3 such as a variable resistor, a variable capacitor or the like has a body and an operating shaft 3*a* supported by the body for angular movement relative thereto about an axis of the operating shaft 3*a*. The body of the variable electric component 3 is accommodated in the recess in the holder 2 such that an axis of the operating shaft 3*a* of the variable electric component 3 coincides with a central axis of the holder 2. A knob 4 has a cylindrical outer peripheral surface 4*b* and has one axial end face formed therein with a recess. An assembly of the holder 2 and the variable electric component 3 is accommodated in the recess in the knob 4 such that the axis of the operating shaft 3*a* coincides with an axis of the knob 4. The knob 4 is mounted to the other of the above-mentioned pair of mount plates for angular movement relative thereto about the axis of the operating shaft 3*a*.

The operating shaft 3*a* of the variable electric component 3 has an end portion formed with a pair of diametrically opposed planar surface sections. The end portion of the operating shaft 3*a* is fitted in a central bore 4*a* which is formed in a bottom of the recess in the knob 4 and which is complementary in cross-sectional shape to the end portion of the operating shaft 3*a*, so that the operating shaft 3*a* of the variable electric component 3 is movable together with the knob 4 angularly about the axis of the operating shaft 3*a*. The variable electric component 3 is provided with a plurality of terminals 3*b* which extend through a through bore 2*a* formed in the bottom of the recess in the holder 2. Forward ends of the respective terminals 3*b* are exposed to the outside, whereby lead wires can be connected to the forward ends of the respective terminals 3*b* by means of soldering or the like.

The cylindrical outer peripheral surface 4*b* of the knob 4 is formed with irregularities by means of knurling or the like so that the outer peripheral surface 4*b* is given high friction resistance in order to facilitate manipulation of the knob 4. A part of the outer peripheral surface 4*b* is exposed to the outside through a window 5*a* formed in an operating panel 5, as shown in FIG. 2.

The holder 2 is provided on its one axial end face with a projection 2*b*. On the other hand, an arcuate projection 4*c* is formed on the bottom of the recess in the knob 4 and extends along the peripheral wall surface of the recess. When the knob 4 is moved angularly about the axis of the operating shaft 3*a* relatively to the holder 2 and the body of the variable electric component 3, either one of the opposite ends 4*d* and 4*e* of the arcuate projection 4*c* can be abutted against the projection 2*b* on the holder 2, thereby limiting the angular movement of the knob 4.

In use of the electric regulator unit 1 constructed as above, an operator manipulates, with this finger, the part of the outer peripheral surface 4*b* of the knob 4, which is exposed to the outside through the opening 5*a* in the operating panel 5, in the direction indicated by X in FIG. 2. The operator's manipulation moves the knob 4 angularly about the axis of the operating shaft 3*a* of the variable electric component 3. The angular movement of the knob 4 is transmitted to the operating shaft 3*a* through the engagement between the bore 4*a* in the knob 4 and the end portion of the operating shaft 3*a*. Thus, the operating shaft 3*a* is moved angularly about its axis, whereby the variable electric component 3 can be set or adjusted to any desired resistance or capacitance value.

However, the electric regulator unit constructed as described above has the following problems. That is, since the diameter of the cylindrical outer peripheral surface 4*b* of the knob 4 is relatively large, only an extremely small manipulating force is required for angularly moving the knob 4. Threfore, an inadvertent light touch on the outer peripheral surface 4*b* of the knob 4 causes the operating shaft 3*a* of the variable electric component 3 to be moved angularly so that the electric value of the variable electric component 3 is deviated from the set desired value unintentionally.

SUMMARY OF THE INVENTION

It is therefore an object of the invention to provide an electric regulator unit capable of ensuring that an inadverent light touch on an outer peripheral surface of a knob causes the knob to be angularly moved unintentionally.

According to the invention, there is provided an electric regulator unit comprising:

a variable electric component having a body and an operating shaft supported by the body for angular movement relative thereto about an axis of the operating shaft, the operating shaft having an end portion which projects axially from one axial end face of the body;

a holder for the variable electric component, the holder having one axial end face formed therein with a recess, the body of the variable electric component being accommodated in the recess against angular movement relative to the holder about the axis of the operating shaft in such a manner that the end portion of the operating shaft extends away from a bottom of the recess;

a knob for moving the operating shaft of the variable electric component angularly about the axis of the operating shaft relatively to the body of the variable electric component, the knob having a cylindrical outer peripheral surface concentric to the axis of the operating shaft, the knob having one axial end face formed therein with a recess, wherein an assembly of the variable electric component and the holder is accommodated in the recess in the knob in such a manner that the one axial end face of the body of the variable electric component and the one axial end face of the holder are opposed to a bottom of the recess in the knob, and wherein the end portion of the operating shaft is engaged with the bottom of the recess in the knob such that the operating shaft is movable, together with the knob, about the axis of the operating shaft, the arrangement being such that the outer peripheral surface of the knob is manipulated to move the knob angularly about the axis of the operating shaft relatively to the holder and the body of the variable electric component, thereby moving the operating shaft about the axis thereof relatively to the body; and friction-torque imparting means arranged between the knob and the assembly for imparting friction torque to the angular movement of the knob relatively to the holder and the body of the variable electric component.

As described above, the arrangement of the electric regulator unit according to the invention is such that the friction-torque imparting means imparts friction torque to the angular movement of the knob relative to the holder and the body of the variable electric component. In this manner, the torque required for angularly moving the knob is increased by the friction-torque imparting means. Thus, it can effectively be prevented that an inadverent light touch on the outer peripheral surface of the knob causes the knob to be angularly moved. Accordingly, it is possible to prevent the electric value of the variable electric component from being deviated unintentionally from a set desired value.

DETAILED DESCRIPTION

Figure 1:
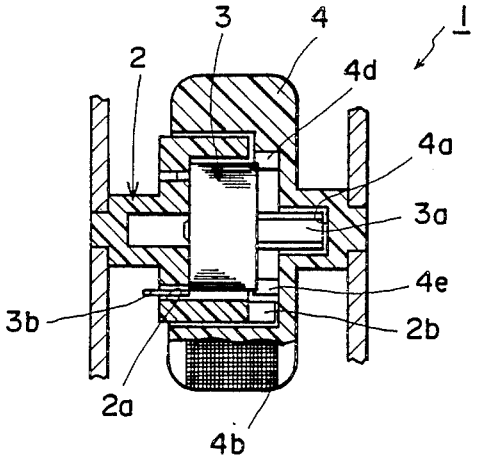
FIG. 1 Prior Art
FIG. 1 is a cross-sectional view of a conventional electric regulator unit.
Figure 2:
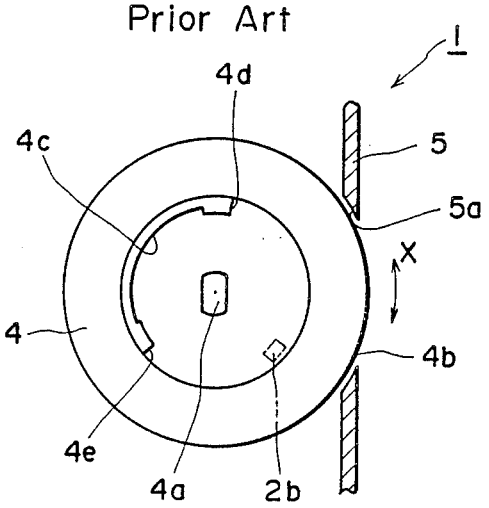
FIG. 2 Prior Art
FIG. 2 is a front elevational view of a knob illustrated in FIG. 1.
Figure 3:
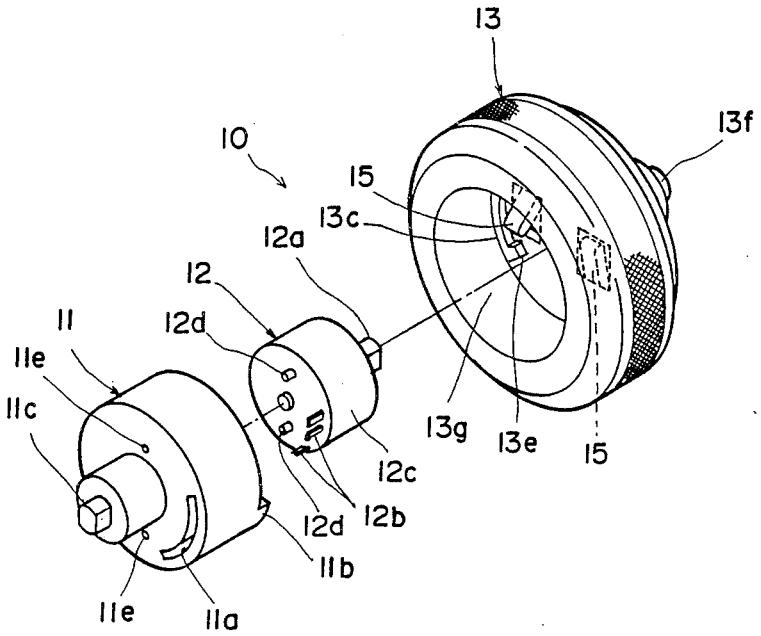
FIG. 3 is an exploded perspective view of an electric regulator unit according to an embodiment of the invention.
Figure 4:
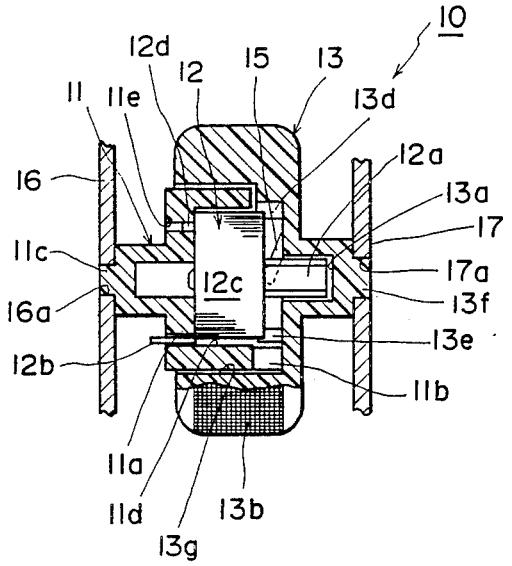
FIG. 4 is a cross-sectional view of the electric regulator unit illustrated in FIG. 3.
Figure 5:
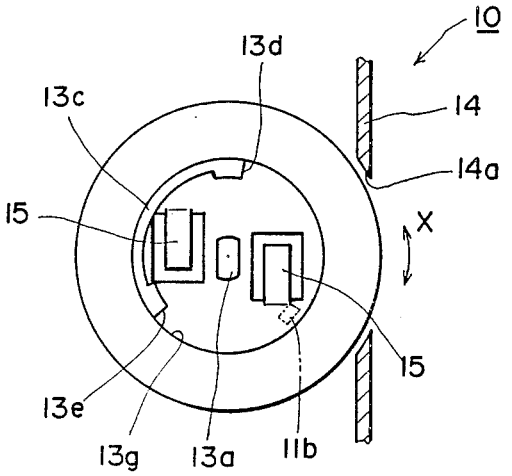
FIG. 5 is a front elevational view of a knob illustrated in FIGS. 3 and 4.

Referring to FIGS. 3 through 5, there is shown an electric regulator unit, generally designated by the reference numeral 10, according to an embodiment of the invention. A plurality of such electric regulator units are arranged on the inside of an instrument panel 14 (see FIG. 5) of, for example, an air conditioner for automotive vehicles, a car stereo player or the like.

The electric regulator unit 10 comprises a variable electric component 12 such as a variable resistor, a variable capacitor or the like. The variable electric component 12 has a body 12*c* and an operating shaft 12*a* supported by the body 12*c* for angular movement relative thereto about an axis of the operating shaft 12*a*. The body 12*c* has a cylindrical outer peripheral surface concentric to the axis of the operating shaft 12*b*. The operating shaft 12*a* has an end portion which projects axially from one axial end face of the body 12*c*. The end portion of the operating shaft 12*a* is formed with a pair of planar surface sections which are opposed diametrically to each other in parallel relation to each other, so that the end portion of the operating shaft 12*a* is non-circular in cross-sectional shape.

A holder 11 for the variable electric component 12 has a cylindrical outer peripheral surface concentric to the axis of the operating shaft 12*a*. The holder 11 has one axial end face formed therein with a recess 11*d* which is circular in cross-sectional shape in a plane perpendicular to the axis of the operating shaft 12*a*. The body 12*c* is accommodated in the recess 11*d* against angular movement relative thereto about the axis of the operating shaft 12*a* in such a manner that the end portion of the operating shaft 12*a* extends away from a bottom of the recess 11*d*. The holder 11 is provided with a projection 11*c* which is non-circular in cross-sectional shape and which projects axially from the other axial end face of the holder 11. The projection 11*c* is fitted in a complementary bore 16*a* formed in a mount plate 16 against rotation relative thereto. The mount plate 16 extends perpendicularly to the instrument panel 14 (see FIG. 5).

The variable electric component 12 is provided with a pair of detent pins 12*d* and 12*d* which project axially from the other axial end face of the body 12*c* of the variable electric component 12. The pair of detent pins 12*d* and 12*d* are fitted respectively in through bores 11*e* and 11*e* formed in the bottom of the recess lid in the holder 11. The pair of detent pins 12*d* and 12*d* cooperate with the bores 11*e* and 11*e* to prevent the body 12*c* of the variable electric component 12 from angularly moving relatively to the holder 11 about the axis of the operating shaft 12*a*. Moreover, the variable electric component 12 is provided with a plurality of terminals 12*b* which project axially from the other end face of the body 12*c*. The terminals 12*b* extend through a through bore 11*a* formed in the bottom of the recess 11*d* in the holder 11. Forward ends of the respective terminals 12*b* are exposed to the outside, whereby lead wires can be connected to the forward ends of the respective terminals 12*b* by means of soldering or the like.

A knob 13 is provided for moving the operating shaft 12*a* of the variable electric component 12 angularly about the axis of the operating shaft 12*a* relatively to the body 12*c* of the variable electric component 12. The knob 13 has a cylindrical outer peripheral surface 13*b* concentric to the axis of the operating shaft 12*a*. The outer peripheral surface 13*b* of the knob 13 is formed with irregularities by means of knurling or the like so that the outer peripheral surface 13*b* is given high friction resistance in order to facilitate manipulation of the knob 13. The knob 13 has one axial end face formed therein with a recess 13*g* which is circular in cross-section in the plane perpendicular to the axis of the operating shaft 12*a* of the variable electric component 12. An assembly of the variable electric component 12 and the holder 11 is accommodated in the recess 13*g* in the knob 13 in such a manner that the one axial end face of the body 12*c* of the variable electric component 12 and the one axial end face of the holder 11 are axially opposed to a bottom of the recess 13*g* in the knob 13. A central bore 13*a* complementary in cross-sectional shape to the end portion of the operating shaft 12*a* is formed in the bottom of the recess 13*g* in the knob 13. The end portion of the operating shaft 12*a* is fitted in the bore 13*a* such that the operating shaft 12*a* is moveable, together with the knob 13, about the axis of the operating shaft 12*a*. The knob 13 is provided with a projection 13*f* which is circular in cross-sectional shape and which projects axially from the other axial end face of the knob 13. The projection 13*f* is fitted in a complementary bore 17*a* formed in a mount plate 17 such that the knob 13 is movable angularly about the axis of the operating shaft 12*a* relatively to the mount plate 17. The mount plate 17 extends perpendicularly to the instrument panel 14 and parallel to the mount plate 16. A part of the outer peripheral surface 13*b* of the knob 13 is exposed to the outside through a window 14a formed in the operating panel 14, as shown in FIG. 5.

The arrangement is such that the part of the outer peripheral surface 13b of the knob 13, which is exposed to the outside through the window 14a in the operating panel 14, is manipulated to move the knob 13 angularly about the axis of the operating shaft 12a relatively to the holder 11 and the body 12c of the variable electric component 12, thereby moving the operating shaft 12a about the axis thereof relatively to the body 12c.

The holder 11 is provided with a projection 11b which projects axially from one axial end face of the holder 11. On the other hand, as clearly shown in FIG. 5, an arcuate projection 13c is formed on the bottom of the recess 13g in the knob 13 and extends along the peripheral wall surface of the recess 13g. When the knob 13 is moved angularly about the axis of the operating shaft 12a relatively to the holder 11 and the body 12c of the variable electric component 12, either one of the opposite ends 13d and 13e of the arcuate projection 13c can be abutted against the projection 11b on the holder 11, so that the angular movement of the knob 13 is limited.

A pair of elastically or resiliently deformable projections 15 and 15 are provided on the bottom of the recess 13g in the knob 13 in integral relation thereto. As clearly seen from FIG. 3, the projections 15 and 15 extend from the bottom of the recess 13g toward the one axial end face of the knob 13 in an inclined fashion. When the assembly of the variable electric component 12 and the holder 11 is fitted in the recess 13g in the knob 13, forward ends of the respective projections 15 and 15 can be abutted against an annular area on the one axial end face of the body 12c of the variable electric component 12 which extends about the end portion of the operating shaft 12a. When the electric regulator unit 10 is mounted between the pair of mount plates 16 and 17, the assembly of the holder 11 and the variable electric component 12 is urged against the bottom of the recess 13g in the knob 13. The projections 15 and 15 are deformed elastically or resiliently by the one axial end face of the body 12c of the variable electric component 12, so that the forward ends of the respective projections 15 and 15 are pressed against the annular area on the one axial end face of the body 12c. Thus, the projections 15 and 15 serve as friction-torque imparting means for imparting friction torque to the angular movement of the knob 13 relative to the holder 11 and the body 12c of the variable electric component 12. That is, the forward ends of the respective projections 15 and 15 are capable of being in sliding contact with the annular area on the one axial end face of the body 12c of the variable electric component 12 while being deformed elastically when the knob 13 is moved angularly about the axis of the operating shaft 12a relatively to the holder 11 and body 12c, thereby imparting friction torque to the angular movement of the knob 13 relative to the holder 11 and the body 12c.

When it is desired to set or adjust an electric value of the variable electric component 12, an operator manipulates, with his finger, the part of the irregular outer peripheral surface 13b of the knob 13, which is exposed to the outside through the window 14a in the operating panel 14, in the direction indicated by X in FIG. 5. The knob 13 is moved angularly about the axis of the operating shaft 12a, against the friction torque due to sliding contact of the forward ends of the elastically deformed projections 15 and 15 with the annular area on the one axial end face of the body 12c of the variable electric component 12. The angular movement of the knob 13 is transmitted to the operating shaft 12a through the engagement between the end portion of the operating shaft 12a and the bore 13a in the bottom of the recess 13g in the knob 13, to move the operating shaft 12a about the axis thereof. Thus the electric value of the variable electric component 12 is adjusted or set to a desired value.

As described above, the forward ends of the respective projections 15 and 15 provided on the bottom of the recess 13g in the knob 13 are always abutted, under the respective biasing forces of the elastically deformed projections 15 and 15, against the annular area on the one axial end face of the body 12c of the variable electric component 12. By the abutment of the projections 15 and 15 against the one axial end face of the body 12c, friction torque is imparted to the angular movement of the knob 13 about the axis of the operating shaft 12a relative to the holder 11 and the body 12c of the variable electric component 12, so that torque required for angularly moving the knob 13 is increased. Thus, it can effectively be prevented that an inadvertent light touch on the part of the outer peripheral surface 13b of the knob 13, which is exposed to the outside through the window 14a in the operating panel 14, causes the knob 13 to be angularly moved. Accordingly, it is ensured that once the variable electric component 12 is set to any desired value, the variable electric component 12 is prevented from being deviated from the set desired value unintentionally.

It is to be understood that the invention is not limited to the specific embodiment described above with reference to FIGS. 3 through 5, but various modifications and variations can be made to the invention. For instance, although it has been described that the pair of projections 15 and 15 are provided on the bottom of the recess 13g in the knob 13, only one projection 15 or three or more projections 15 may be provided on the bottom of the recess 13g. Further, it is of course that the projections 15 may be separate from the knob 13. In this case, the separate projections are mounted to the knob 13 by means of, for example, screws. Moreover, in place of the projections 15, at least one elastically deformable projection may be provided on the holder 11 in an integral or separate fashion in such a manner that a forward end of the projection is elastically urged against the bottom of the recess 13g in the knob 13. Alternatively, the at least one projection may be provided on the other axial end face of the holder 11 in such a manner that a forward end of the projection is resiliently urged against the other axial end face of the knob 13. Furthermore, at least one coil spring or leaf spring may be substituted for the pair of projections 15. In this case, the spring is mounted to the other axial end face of the holder 11, and a free end of the spring is abutted against the other axial end face of the knob 13. In short, it will be apparent to one skilled in the art that, essential for the invention is friction-torque imparting means which is arranged between the knob 13 and the assembly of the variable electric component 12 and the holder 11, for imparting friction torque to the angular movement of the knob 13 relative to the holder 11 and the body 12c of the variable electric component 12.

What is claimed is:

1. An electric regulator unit comprising:

a variable electric component having a body and an operating shaft supported by said body for angular movement relative thereto about an axis of said operating shaft, said operating shaft having an end portion which projects axially from one axial end face of said body;

a holder for said variable electric component, said holder having one axial end face formed therein with a recess, said body of said variable electric component being accommodated in said recess against angular movement relative to said holder about said axis of said operating shaft in such a manner that said end portion of said operating shaft extends away from a bottom of said recess;

a knob for moving said operating shaft of said variable elctric component angularly about said axis of said operating shaft relatively to said body of said variable electric component, said knob having a cylindrical outer peripheral surface concentric to said axis of said operating shaft, said knob having one axial end face formed therein with a recess, wherein an assembly of said variable electric component and said holder is accommodated in said recess in said knob in such a manner that said one axial end face of said body of said variable electric component and said one axial end face of said holder are opposed to a bottom of said recess in said knob, and wherein said end portion of said operating shaft is engaged with said bottom of said recess in said knob such that said operating shaft is movable, together with said knob, about said axis of said operating shaft, the arrangement being such that said outer peripheral surface of said knob is manipulated to move said knob angularly about said axis of said operating shaft relatively to said holder and said body of said variable electric component, thereby moving said operating shaft about said axis thereof relatively to said body; and friction-torque imparting means arranged between said knob and said assembly for imparting friction torque to the angular movement of said knob relative to said holder and said body of said variable electric component.

2. An electric regulator unit according to claim 1, wherein said holder has a cylindrical outer peripheral surface concentric to said axis of said operating shaft, and wherein said recess in said knob is circular in cross-sectional shape in a plane perpendicular to said axis of said operating shaft.

3. An electric regulator unit according to claim 2, wherein said body of said variable electric component has a cylindrical outer peripheral surface concentric to said axis of said operating shaft, and wherein said recess in said holder is circular in cross-sectional shape in said plane.

4. An electric regulator unit according to claim 1, wherein said friction-torque imparting means is provided on one of said knob and said assembly and is capable of being in sliding contact with the other while being deformed elastically when said knob is moved angularly about said axis of said operating shaft.

5. An electric regulator unit according to claim 4, wherein said friction-torque imparting means comprises elastically deformble projection means provided on said knob, said projection means having a forward end abutted against said assembly.

6. An electric regulator unit according to claim 5, wherein said projection means is provided in integral relation to said knob, and wherein said forward end of said projection means is abutted against said one axial end face of said body of said variable electric component.

7. An electric regulator unit according to claim 6, wherein said projection means has a pair of projections which are provided on said bottom of said recess in said knob and which have their respective forward ends abutted against said one axial end face of said body of said variable electric component.

8. An electric regulator unit according to claim 1, wherein said variable electric component is one of a variable resistor and a variable capacitor.

9. An electric regulator unit according to claim 1, wherein said outer peripheral surface of said knob is provided with irregularities so that said outer peripheral surface of said knob is given high friction resistance in order to facilitate manipulation of said knob.

10. An electric regulator unit according to claim 1, wherein said bottom of said recess in said knob is provided with a bore in which said end portion of said operating shaft is fitted for angular movement together with said knob about said axis of said operating shaft.

11. An electric regulator unit according to claim 1, including detent means arranged between the other axial end face of said body of said variable electric component and said bottom of said recess in said holder, for preventing said body from angularly moving relatively to said holder about said axis of said operating shaft.

12. An electric regulator unit according to claim 11, wherein said detent means has a pair of detent pins which project axially from the other axial end face of said body of said variable electric component and which are fitted respectively in bores formed in said bottom of said recess in said holder.

* * * * *